US006775888B1

(12) United States Patent
Wegener et al.

(10) Patent No.: US 6,775,888 B1
(45) Date of Patent: Aug. 17, 2004

(54) FORMING SYSTEM AND PROCESS

(75) Inventors: Konrad Wegener, Göppingen (DE); Hans Hofele, Göppingen (DE); Sieghard Muller, Ottenbach (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 345 days.

(21) Appl. No.: 09/443,456

(22) Filed: Nov. 19, 1999

(30) Foreign Application Priority Data

Nov. 19, 1998 (DE) ..... 198 53 365.9

(51) Int. Cl.[7] ..... B23P 21/00

(52) U.S. Cl. ..... 29/33 R; 29/650; 29/563; 72/341; 72/340; 219/121.63; 228/182

(58) Field of Search ..... 72/341, 340, 563; 29/33 R, 650; 219/121.63, 121.64; 228/33, 182

(56) References Cited

U.S. PATENT DOCUMENTS

| | | | | | |
|---|---|---|---|---|---|
| 3,365,926 | A | * | 1/1968 | Price | 72/341 X |
| 3,758,944 | A | * | 9/1973 | Berg | 29/33 R |
| 4,043,167 | A | * | 8/1977 | Koser | 72/340 |
| 4,170,157 | A | * | 10/1979 | Koser | 83/472 |
| 4,201,905 | A | | 5/1980 | Clark et al. | 219/121 L |
| 4,261,274 | A | * | 4/1981 | Spanraft et al. | 72/340 |
| 4,297,774 | A | * | 11/1981 | Medlock | 29/557 |
| 4,639,568 | A | * | 1/1987 | Check et al. | 219/69 M |
| 4,654,505 | A | * | 3/1987 | Sciaky et al. | 228/182 |
| 4,665,607 | A | | 5/1987 | Ressencourt | 29/568 |
| 4,698,480 | A | | 10/1987 | Klingel | 219/121 LG |
| 4,951,376 | A | * | 8/1990 | Grund | 29/650 |
| 5,012,665 | A | | 5/1991 | Brandstetter | 72/405 |
| 5,053,601 | A | * | 10/1991 | Landtwing et al. | 219/121.63 |
| 5,062,195 | A | * | 11/1991 | Binder | 29/563 |
| 5,140,839 | A | | 8/1992 | Bruns | 72/405 |
| 5,187,967 | A | * | 2/1993 | Singh et al. | 72/340 |
| 5,301,863 | A | * | 4/1994 | Prinz et al. | 228/33 |
| 5,468,931 | A | * | 11/1995 | Summerauer | 219/121.63 |
| 5,508,490 | A | * | 4/1996 | Klose | 483/1 |
| 5,525,776 | A | * | 6/1996 | Okamoto | 29/650 |
| 5,695,591 | A | * | 12/1997 | Hamada et al. | 219/121.64 |
| 5,897,796 | A | * | 4/1999 | Forrest | 219/121.64 |

FOREIGN PATENT DOCUMENTS

| | | | | | |
|---|---|---|---|---|---|
| DE | 1194811 | | * | 6/1965 | 72/340 |
| DE | 277409 | | * | 4/1990 | 72/341 |
| DE | 41 28 194 | | | 3/1993 | |
| DE | 42 28 528 | | | 3/1993 | |
| EP | 615799 | A1 | * | 9/1994 | 72/341 |
| GB | 2064402 | | * | 6/1981 | 72/341 |
| JP | 62-79930 | | * | 4/1987 | 29/650 |
| JP | 4-105721 | | | 4/1992 | |
| JP | 5-23935 | | * | 2/1993 | 29/650 |
| JP | 5-38522 | | * | 2/1993 | 29/33 R |
| JP | 5-57548 | | * | 3/1993 | 29/650 |
| JP | 5-96329 | | * | 4/1993 | 29/33 R |

* cited by examiner

*Primary Examiner*—Erica Cadugan
(74) *Attorney, Agent, or Firm*—Crowell & Moring LLP

(57) ABSTRACT

A system for forming workpieces, has at least one forming tool has at least one machining device with a local energy feed. The local feed is provided for machining the workpieces as a separate station within the forming system.

6 Claims, 17 Drawing Sheets

25
9
12
XV
XV
9
22
23
25
12
7
5
21
14
19
18
22
A

FORMING SYSTEM AND PROCESS

BACKGROUND OF THE INVENTION

This application claims priority of DE 198 53 365.9, filed Nov. 19, 1998, the disclosure of which is expressly incorporated by reference herein.

The present invention relates to a system and a process for forming workpieces of the type having at least one forming tool.

Systems of this general type are known in conjunction with corresponding processes, for example, as described in DE 38 32 499 A1 or DE 39 05 069 A1 and EP 04 39 684 B1 or EP 05 47 190 B1. The workpieces produced by such known systems usually are sheet metal pieces, and the most varied forming processes are used, such as deep-drawing, pressing, cutting or is impressing.

Since very large workpieces are usually produced, as a rule, very large forming tools are also required whose masses must be accelerated and braked during each working cycle or stroke of the forming system. On one hand, this disadvantageously requires very large expenditures of material for producing the forming tools and, on the other hand, a very large amount of energy is required.

An even more serious problem concerns the very long development periods for the forming tools. For example, in the development of a motor vehicle, these development periods represent a very large fraction of the entire development time. Possible changes on the forming tools disadvantageously lead to high expenditures.

SUMMARY OF THE INVENTION

An object of the present invention is, therefore, to provide a system for forming workpieces by way of which, as a result of reduced expenditures with respect to material and development, an identical or better forming result can be achieved than by known forming systems. Furthermore, the largest possible amount of flexibility is to be achieved during the retooling, in that the adaptation to another product can take place as much as possible by reprogramming.

According to the invention, this object has been achieved by providing that at least one machining device with a local energy feed for machining the workpieces is provided as a separate station within the forming system.

According to the invention, the forming system now has a machining device with a local energy feed so that the workpieces machined in the forming system can be subjected to an additional machining or a machining which replaces the previously required steps. Such a machining device has the advantage that it has a very low mass and, in addition, can be arranged on the existing forming system. Thereby, for the machining, it does not have to be moved in an oscillating manner and therefore not with a large consumption of energy.

Furthermore, it is advantageous that the system according to the invention for the adaptation to other products can be very easily reprogrammed. Possible changes on the workpieces to be produced can very easily be taken into account without major expenditures.

In the present context, a local energy feed means that the extent of the energy-affected zone or of the machining range without a relative movement between the workpiece and the machining device is small in comparison to the dimension of the workpiece.

A process-type solution carries out the machining of the workpieces with a local energy feed in the cycle of the system.

Concerning the general state of the art with respect to laser machining systems in machine tools, reference is made to DE 34 10 913 A1, DE 41 28 194 C2 and to EP 00 08 773 B1.

BRIEF DESCRIPTION OF THE DRAWINGS

Other objects, advantages and novel features of the present invention will become apparent from the following detailed description of the invention when considered in conjunction with the accompanying drawings.

BRIEF DESCRIPTION OF THE DRAWINGS

Figure 1:
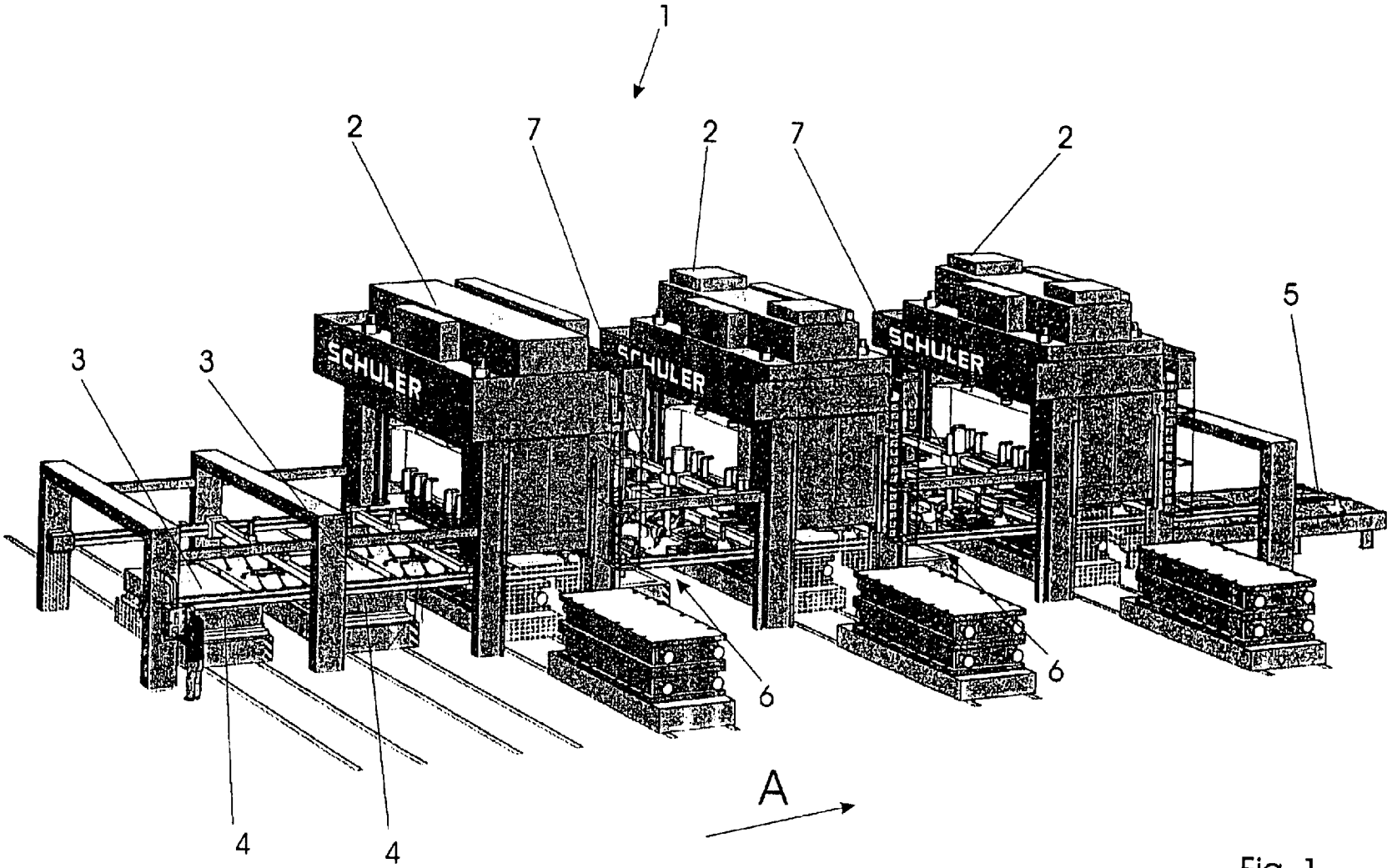
FIG. 1 is a three-dimensional view of a forming system according to the invention.
Figure 2:
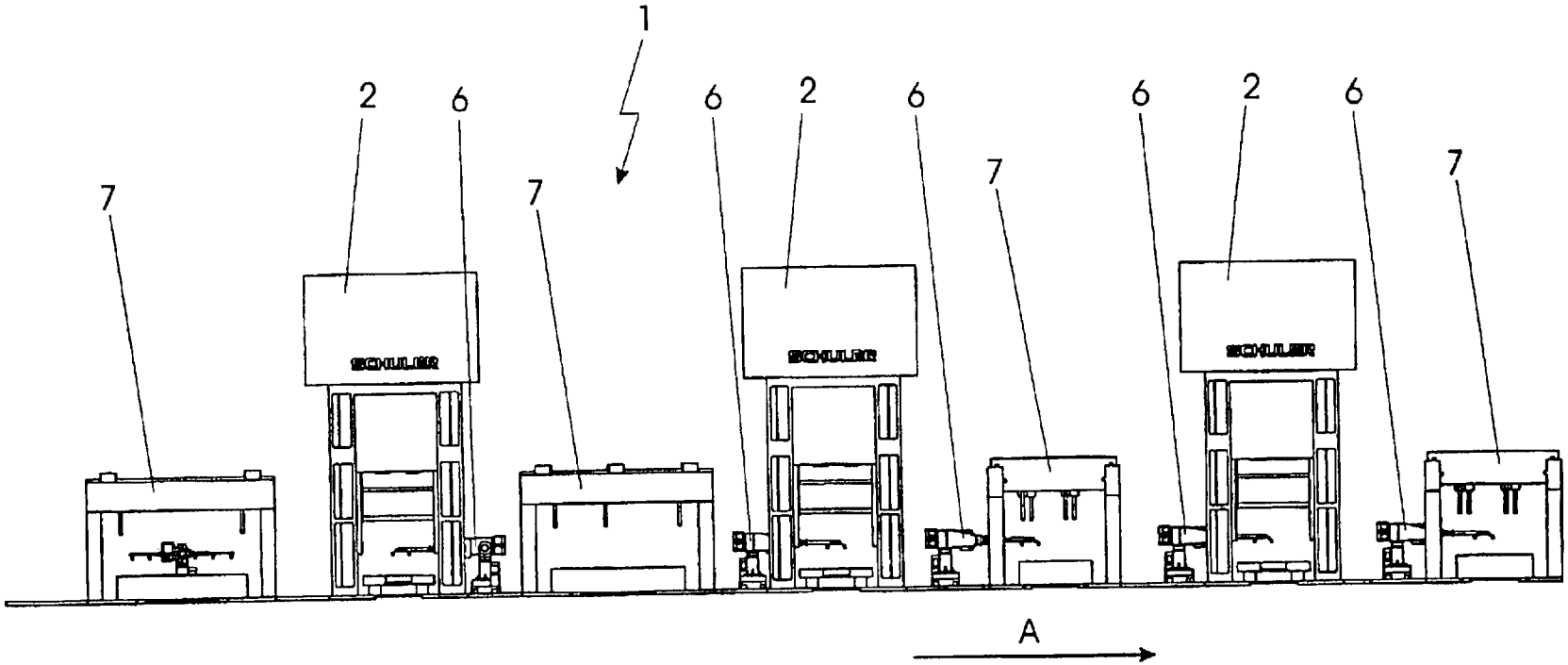
FIG. 2 is a side view of another embodiment of the forming system.
Figure 3:
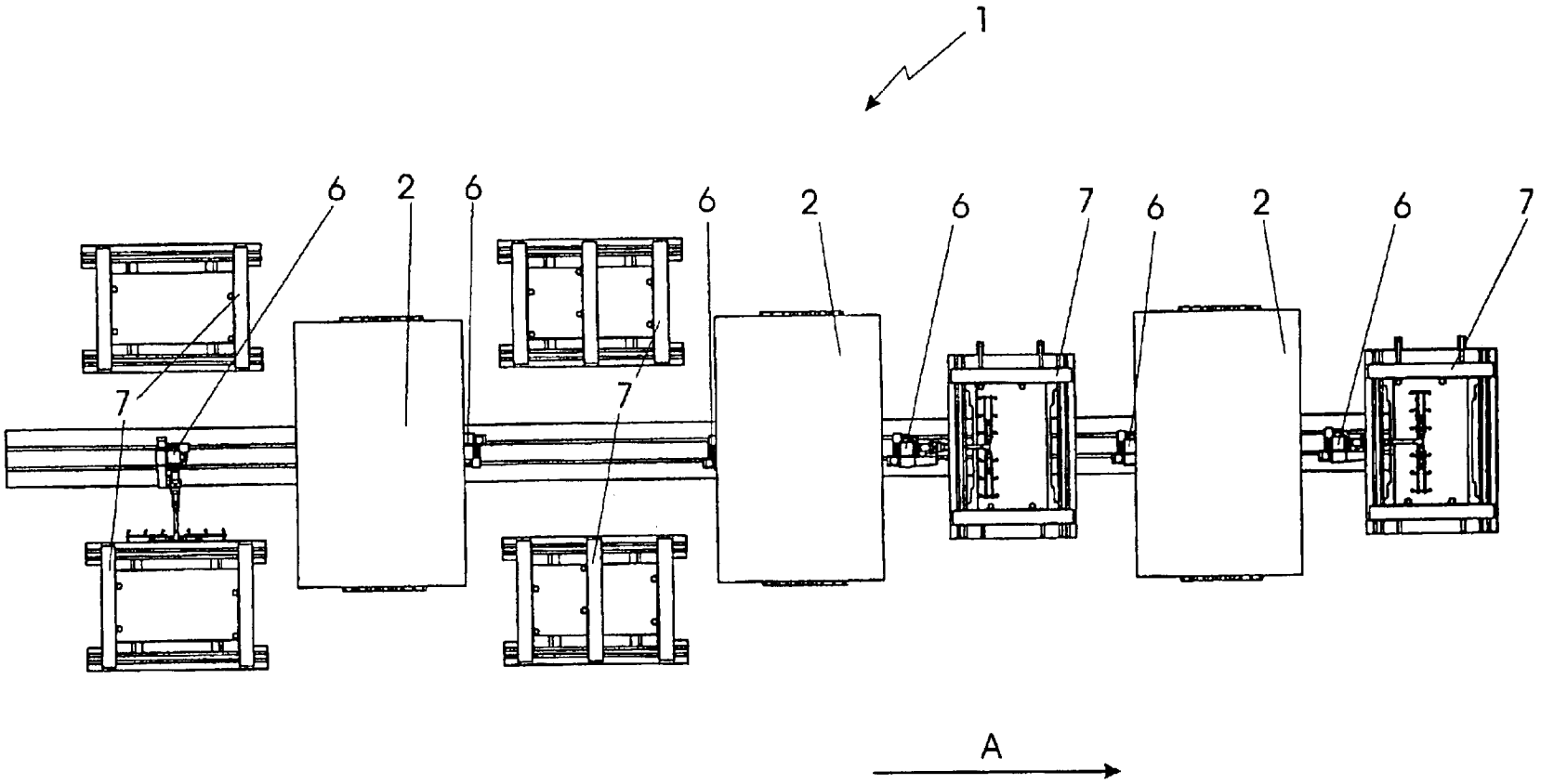
FIG. 3 is a top view of the forming system of FIG. 2.

FIGS. 1, 2 and 3 illustrate a forming system 1 which has several forming stations 2 and is therefore also called a multi-station forming system. In a manner known per se, certain workpieces 5, (for example, a door of a motor vehicle) are produced from metal sheets which are fed to the forming system 1 in the form of metal sheet stacks from so-called blank loaders. The metal sheets 3 and the workpieces 4 successively travel through the forming stations 2 of the forming system 1 and are transported by transport devices 6 from one forming station 2 to the next forming station 2. The forming stations may, for example, be mechanical presses, hydraulic presses, other hydraulic devices or internal-high-pressure forming stations.

The transport devices 6 are also known per se and are constructed, for example, as a system of several manipulation robots or as a programmable two-axis system. In the following description, the construction and the various development possibilities of these transport devices 6 need not therefore be discussed in detail. The transport devices 6 can also be driven by the drive of the forming system 1. The transport direction of the workpieces 5 within the forming system 1 is indicated in the figures by an arrow marked "A".

Additional machining devices 7, by which energy can be fed locally into the workpieces 5, are situated between the forming stations 2. The machining devices 7 may be constructed as laser beam, water jet, plasma jet or sandblasting machining devices 7 or as machining devices 7 for charging electromagnetic energy, for example, by way of induction or conduction, and are in each case provided as a separate station in the forming system 1.

All machining stations 7 described below, for the purpose of a simple description, are constructed as laser beam or laser machining devices 7. The machining devices 7 form individual separate stations within the forming system 1; are used, like the forming stations 2, for machining the workpieces 5; and are equal to these. As illustrated in detail in the following, such a machining by the laser machining device 7 can be a cutting machining, a welding machining, an application machining, a removal machining or a machining for thermally treating the workpieces 5.

The forming system 1 has a certain cycle in which the workpieces 5 are machined and are ejected or discharged from the last forming station 2. The cycle of the machining of the workpieces S is a regular sequence of machining operations. This cycle relates to the complete forming system 1, in which case a certain phase offset may occur between the individual forming stations or the machining stations 7. The machining devices 7 can operate in this cycle of the forming system 1.

As illustrated in FIG. 3, two machining devices 7 may also be arranged in parallel behind one of the forming stations 2. For example, this parallel arrangement is used if the machining of the workpieces 5 by the machining devices 7 requires a fairly long time and nevertheless the same number of workpieces 5 is to be produced as by way of the preceding forming station 2. From the two machining stations 7 arranged in parallel to one another, the workpieces 5 are then again be guided together to the next forming station 2.

Figure 4:
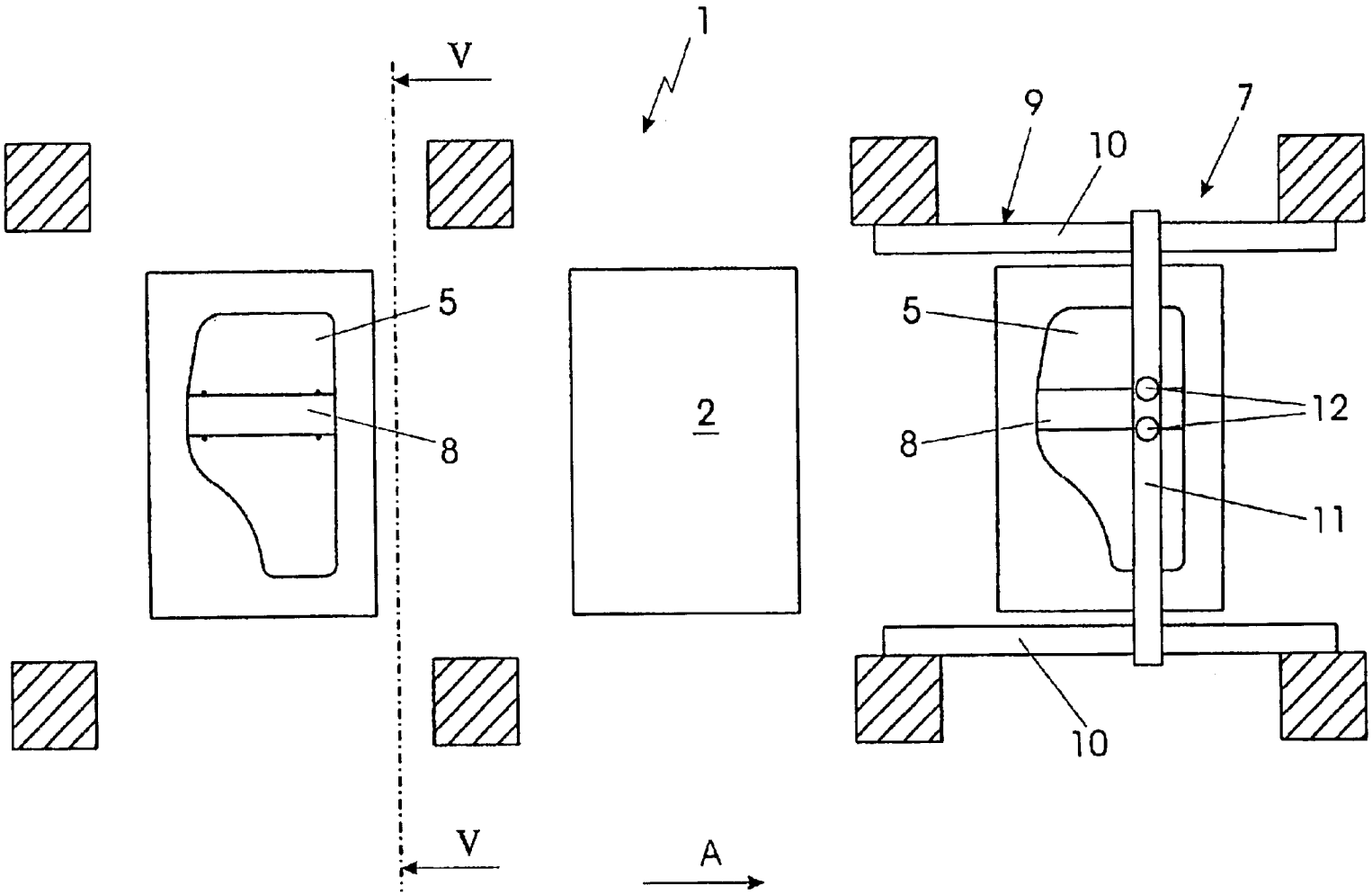
FIG. 4 is a top view of a first embodiment of integrating machining devices according to the invention in a forming system.

FIG. 4 shows the integration of a laser machining device 7 into a forming system 1 on a concrete example. Here, two machining stations 7 and one forming station 2 of the forming system 1 are illustrated. In the first machining device 7, a reinforcing blank 8 is moved into the forming system 1 by a magnetic tape 13 illustrated in FIG. 5 and is applied to a pretreated workpiece 5 by point welding. A transport device transports the workpiece 5 to the next forming station 2; here in particular, a drawing station. In this drawing station, a forming machining of the workpiece 5 takes place in a manner known per se.

From there, the workpiece 5 is transported by another transport device 6 to a next laser machining station 7, which in this embodiment has a manipulating device 9, specifically a cross table 9 with two longitudinal traverses 10 and one cross traverse 11 extending on the latter. Furthermore, the laser machining device 7 is provided with two machining elements 12 constructed as laser heads. Of course, the number of laser heads 12 on the laser machining device 7 and the number of manipulation devices 9 may also be arbitrary, i.e. increased or decreased as needed. A machining device 7 generally consists of machining elements or machining tools 12 which may therefore also be elements for machining the workpieces 5 by water jets, sandblasting or plasma jets, or machining elements 12 for charging electromagnetic or other types of energy at a certain point into the workpieces 5.

By way of the laser heads 12, the reinforcing blank 8, which had been point-welded on as described above, can be welded to the workpiece 5. For this purpose, the laser heads 12 are moved by the cross table 9 in the desired manner two-dimensionally over the workpiece 5. It is also within the scope of the present invention to use laser heads 12 so that a cutting machining or other machining can be carried out on the workpiece 5.

The entire machining range is formed by the relative movement between the laser heads or the machining elements 12 and the surface of the workpiece 5 along defined and programmed paths. This range can therefore also approximately or completely assume the size of the workpiece 5.

A relative movement takes place between the workpiece 5 and the machining device 7 or the machining element 12 to provide for the machining of the workpieces 5. This relative movement can be achieved either by moving the workpiece 5 or the machining element 12, in the above-described embodiment, the manipulation device 9 providing the relative movement and thus permitting a path-controlled machining. As mentioned above, a path-controlled machining of the workpiece could also be carried out by moving the workpiece 5.

From this laser machining device 7, the workpiece 5 is moved in a generally known manner to another forming station 2 arranged behind the laser machining device 7. If the workpiece 5 is finished behind the laser machining device 7, this workpiece 5 can, of course, be conveyed.

Laser beam sources required for supplying the laser heads 12 may be constructed from conventional sources, for example, as Nd-YAG lasers or $CO_2$ lasers. In a first-mentioned embodiment, the laser head 12 is supplied with light or energy by way of optical waveguides; whereas in a second embodiment, the laser head 12 is supplied with light or energy by way of a mirror lens system.

Figure 5:
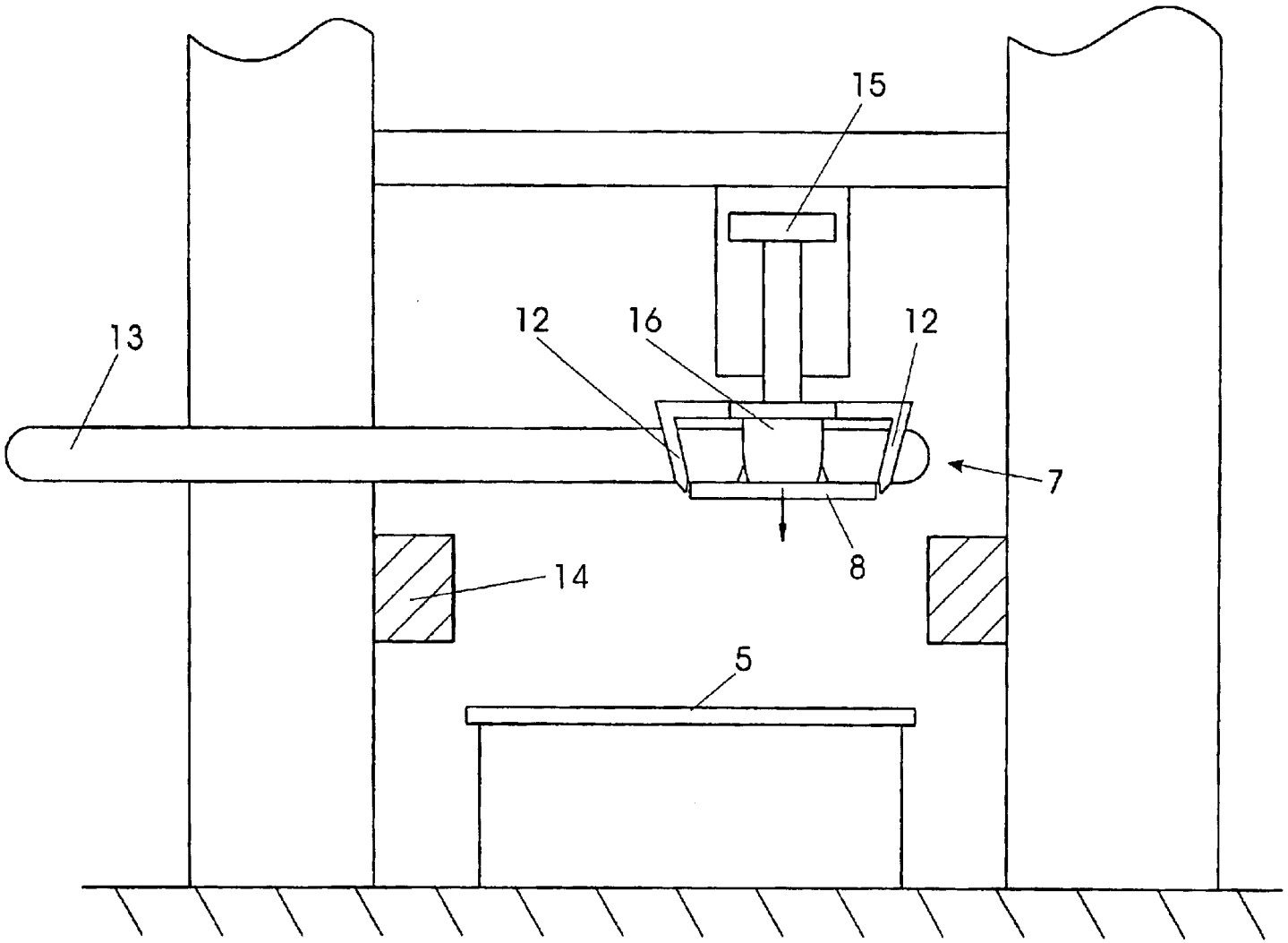
FIG. 5 is a sectional view of the first forming stage along line V—V of FIG. 4 with an additional manipulating device for feeding reinforcing blanks.

FIG. 5 is a sectional view of the first laser machining device 7 of FIG. 4. In this case, the reinforcing blank 8 is guided to the workpiece 5 by an additional feeding device 13, specifically a magnetic tape 13 intervening from the side, whereby these two parts, as described above, can be connected with one another by weld points. FIG. 5 also shows, as part of the transport device 6, a stroke beam 14, which is used as a guiding element 14, as well as a stroke device 15 for the reinforcing blank B and the laser head or the laser heads 12 which is provided with a vacuum suction device 16 for holding the reinforcing blank 8. The stroke beam 14 can be lifted and lowered in a generally known manner and is used as the guide of cross traverses and on which holding devices are mounted for transporting the workpieces. The stroke device 15 presses the reinforcing blank 8 onto the workpiece 5, and the laser heads 12 point-weld the blank 8 to the workpiece 5. The control required for this purpose can take place by a control unit of the forming system 1. The guiding element 14 is a stroke beam, but may also be a different type of guiding element 14.

Figure 6:
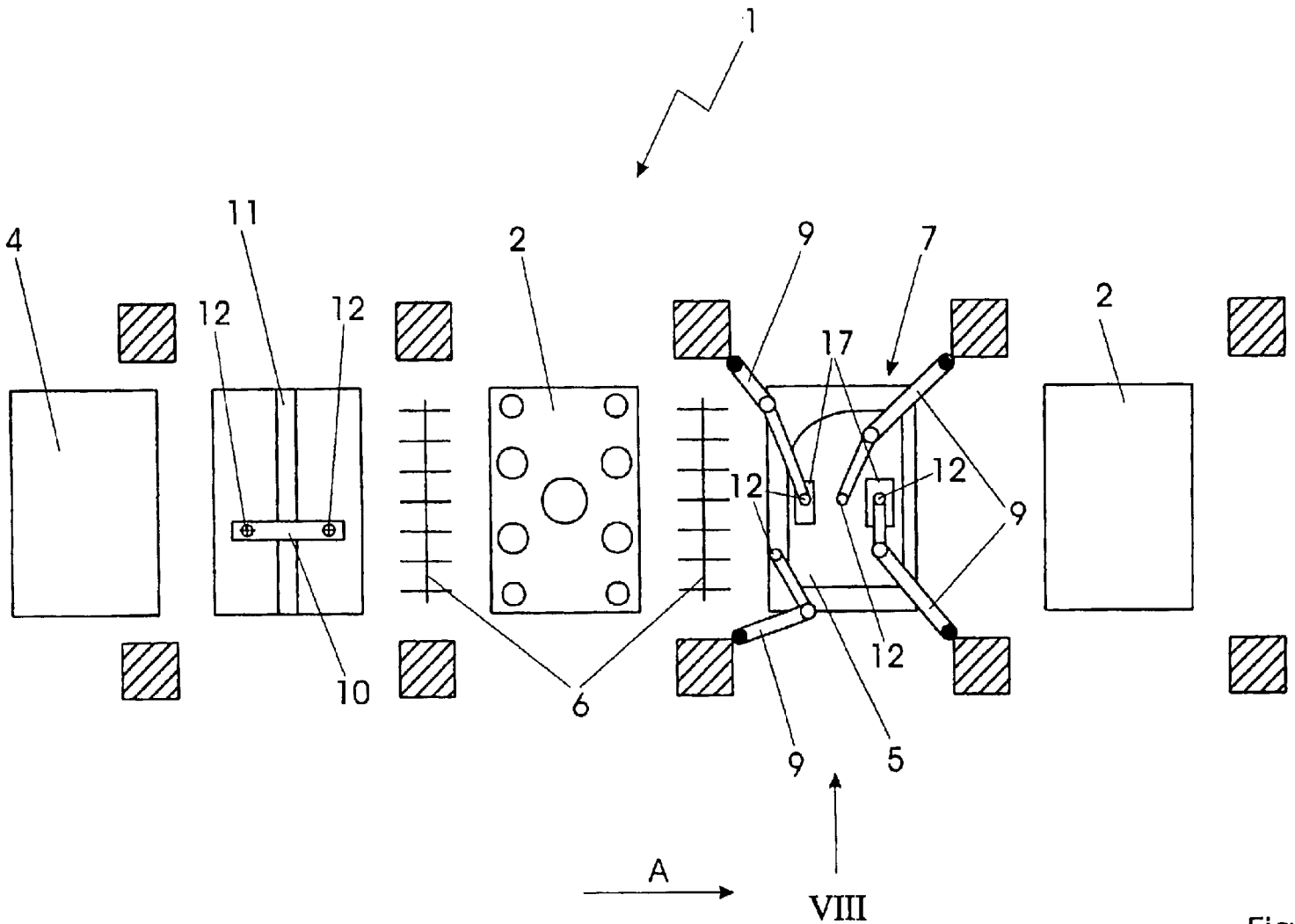
FIG. 6 is a top view of a second embodiment of integrating machining devices according to the invention in a forming system.

FIG. 6 is a top view of another embodiment of integrating one or several of the laser machining devices 7 in the forming system 1. In this embodiment, the metal sheets 3 are fed by the blank loader 4 into the forming system 1. One of the laser machining devices 7 is provided as the first machining station and has the cross table 9 and the two laser heads 12. In contrast to the cross table 9 illustrated in FIG. 4, however, the cross table 9 has only one longitudinal traverse 10 and one cross traverse 11. The operation of this laser machining device 7 is similar to the one illustrated in FIG. 4, in which the metal sheets 3 are subjected to a forming cut. That is, corners or recesses are cut off the metal sheets in order to produce from, for example, a trapezoidal cut, a form cut blank as the workpiece 5 which is suitable for the subsequent forming operation. As an alternative to the cross table, the manipulation device 8 could be constructed as an overhead gantry.

By way of the transport device 6 which, the workpiece 5 is forwarded to another forming station 2, specifically to a drawing station. From there, the workpiece 5 arrives, by way of another transport device 6, at the next laser machining device 7. The laser heads 12 are mounted on manipulation devices constructed as swivel arm robots 9. The laser heads 12 are capable of machining the workpiece 5 in the most varied manners, specifically by a cutting machining, a welding machining, an application machining, a removal machining or a machining for a thermal treatment.

The laser heads 12 are used for providing recesses 17 in the workpiece 5. These may, for example, be windows in the doors of motor vehicles. In this process, the laser heads 12 on the robots 9 can be moved completely independently of one another in all three directions in space and can be swivelled by two or more angles. Thus, also workpieces 5 can be machined which have complicated shapes. For example, a bore, can be made such in a workpiece 5 which is to be formed later that, although it is non-circular before the forming, it is exactly round after the forming. Depending on the type of programming of the robots 9, the machining can already be started while the transport device 6 has not yet reached its end position. This results in a corresponding saving of time.

From this laser machining device 7, the machined workpiece 5 is then conveyed by another transport device 6 to the next forming station 2. Again, it is to be understood that the laser machining device 7 could also be followed by another laser machining device 7 or any other type of machining device 7 with a local energy feed into the workpieces 5. This machining device could then, for example, carry out a thermal treatment on the workpieces 5.

Figure 7:
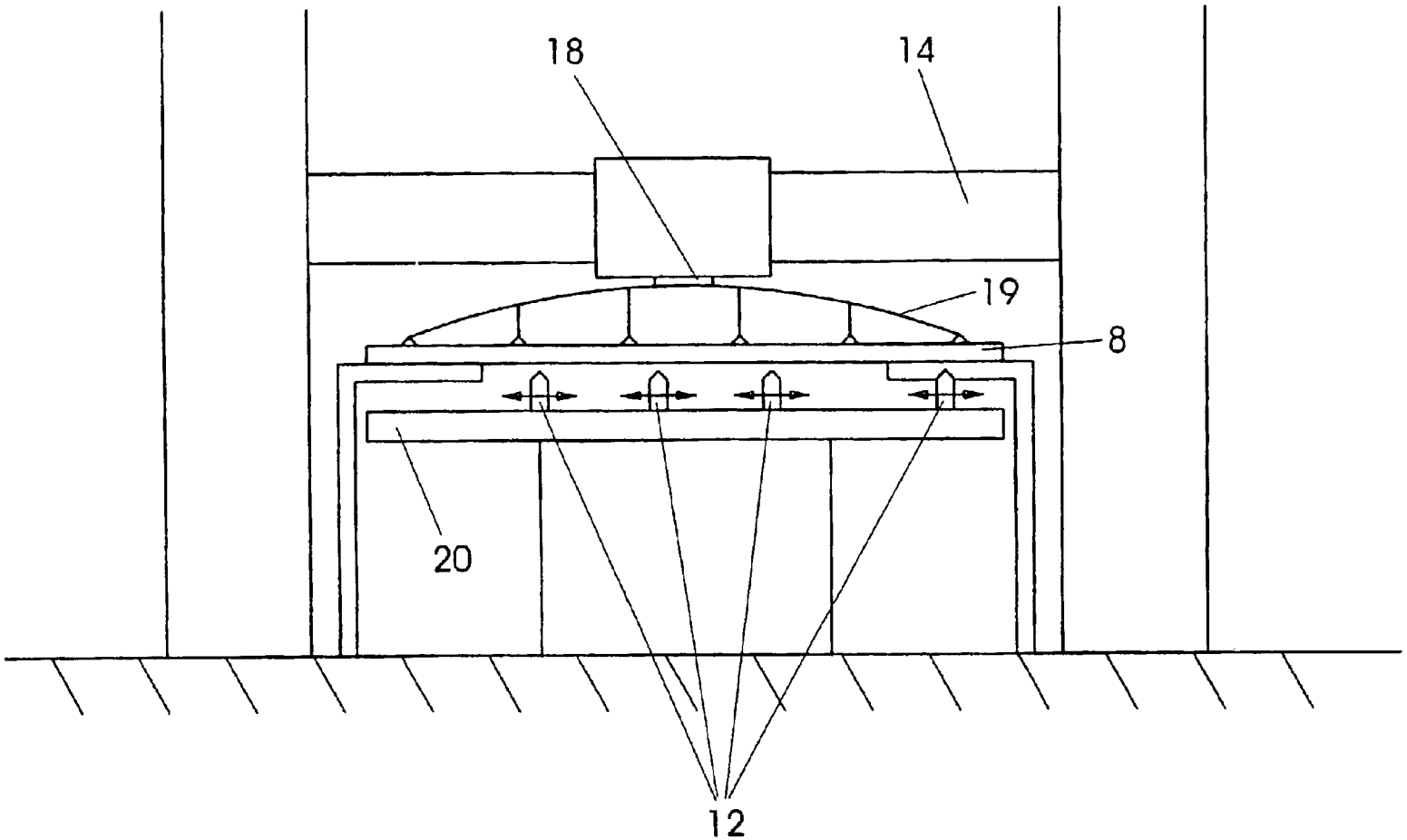
FIG. 7 is a representation of a modification of the forming system illustrated in FIG. 6.

FIG. 7 illustrates a modification of the first laser machining device 7 of FIG. 6 which can also carry out the above-described form cut on the workpiece 5. By way of a suction bridge 18, which is mounted on the guiding element 14 of the transport device 6 and has a pertaining suction spider 19, the workpiece 5 is brought to the laser machining device 7. In this embodiment, the device 7 consists of four laser heads 12 which are displaceably mounted on a cross traverse 20 which, in turn, can be displaced transversely to its dimension. The displaceability of the laser heads 12 is indicated by double-headed arrows. As a result, it is possible to machine the workpiece 5 fed from above already in a cutting manner when the suction bridge 18 has deposited the workpiece 5 above the cross traverse 20 and has not yet completely moved away from it. The suction bridge 18 and suction spider 19 elements are customary in forming technology and do not have to be discussed here in detail.

Figure 8:
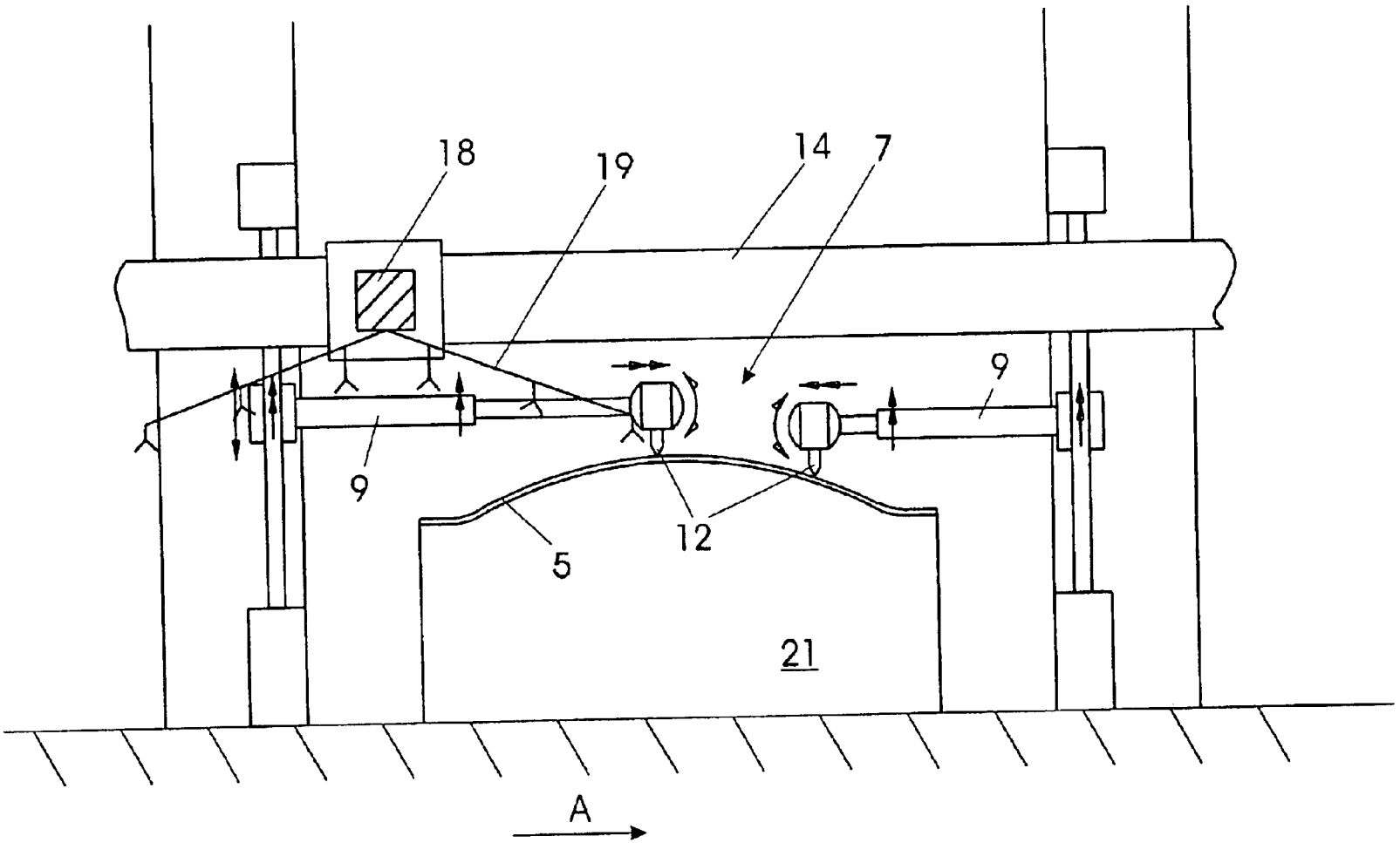
FIG. 8 is a side view along arrow VIII of FIG. 6.

FIG. 8 is a lateral view of the third machining device illustrated in FIG. 6. As in the second station of FIG. 6, the laser heads 12 are mounted on manipulation devices 9 constructed as swivel arm robots, which, according to a cartesian system of coordinates, can be moved three dimensionally. This permits a machining of three-dimensionally formed workpieces 5. In addition, a swivelling of the laser heads 12 or a rotating of individual axes of the manipulation device 9 can also be provided. The rotation of the axes as well as additional possible movements of the manipulation device 9 are indicated by corresponding arrows. The suction bridge 18 is also shown here which is part of the transport device 6, is mounted on the stroke beam 14 of the transport device 6 and has the suction spider 19. By way of the suction bridge 18, the workpiece 5 can be placed in the laser machining device 7 and can be deposited on a depositing element 21. The laser machining by the laser heads, which are in the rear in the transport direction, can start before the loaded suction bridge 18 was moved back.

Figure 9:
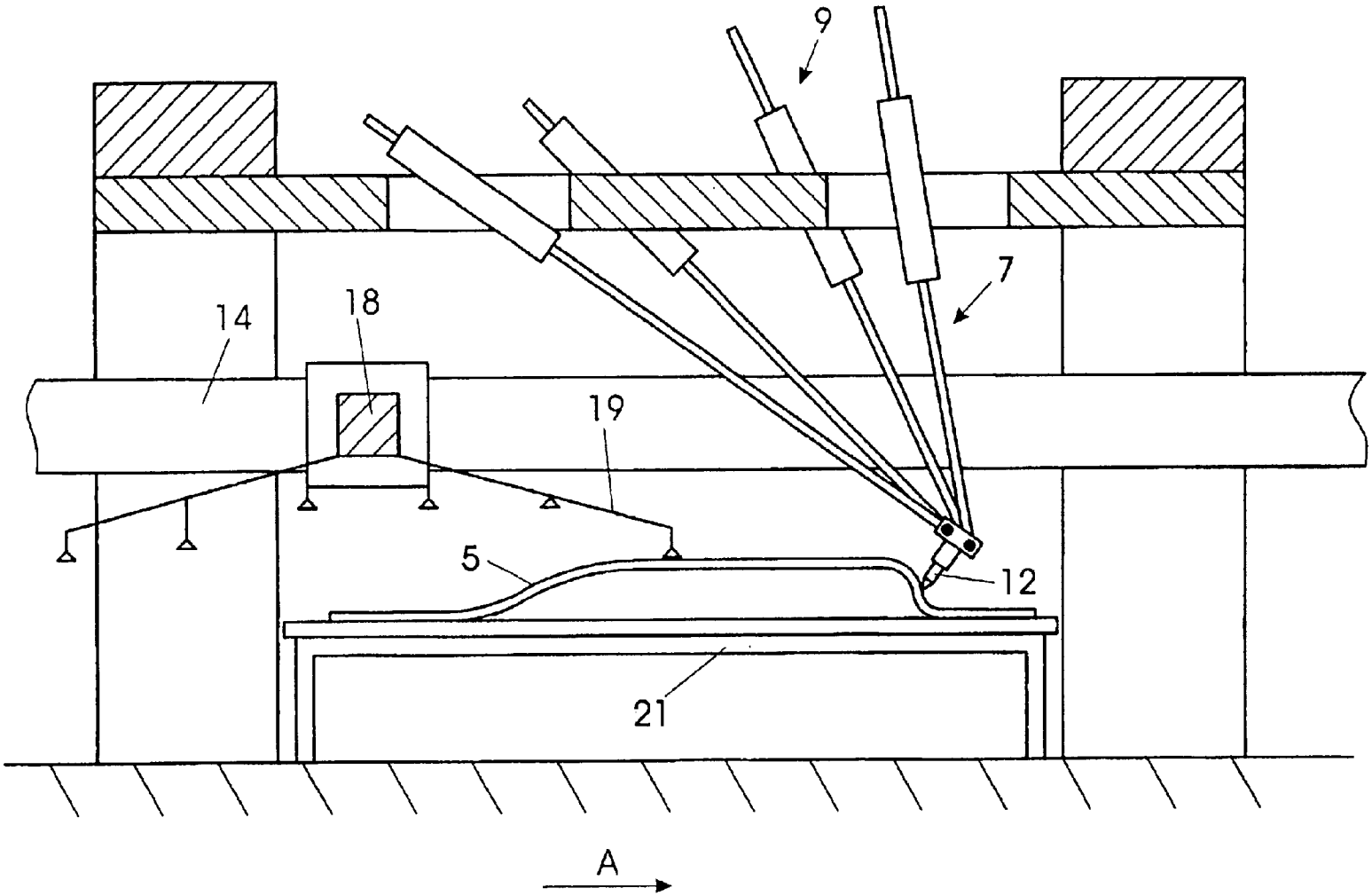
FIG. 9 is a view of an alternative embodiment of the representation according to FIG. 8 with a robot having parallel kinematics as a manipulating device.

FIG. 9 shows an alternative embodiment of the manipulation device 9 which is constructed as a robot with parallel kinematics. Robots 9 constructed in this manner can reach high moving speeds and have a high rigidity, which permits a very precise machining. As a result, non-planar workpieces 5 can also be machined, as described above, by the machining element 12 mounted on the robot 9.

Figure 10:
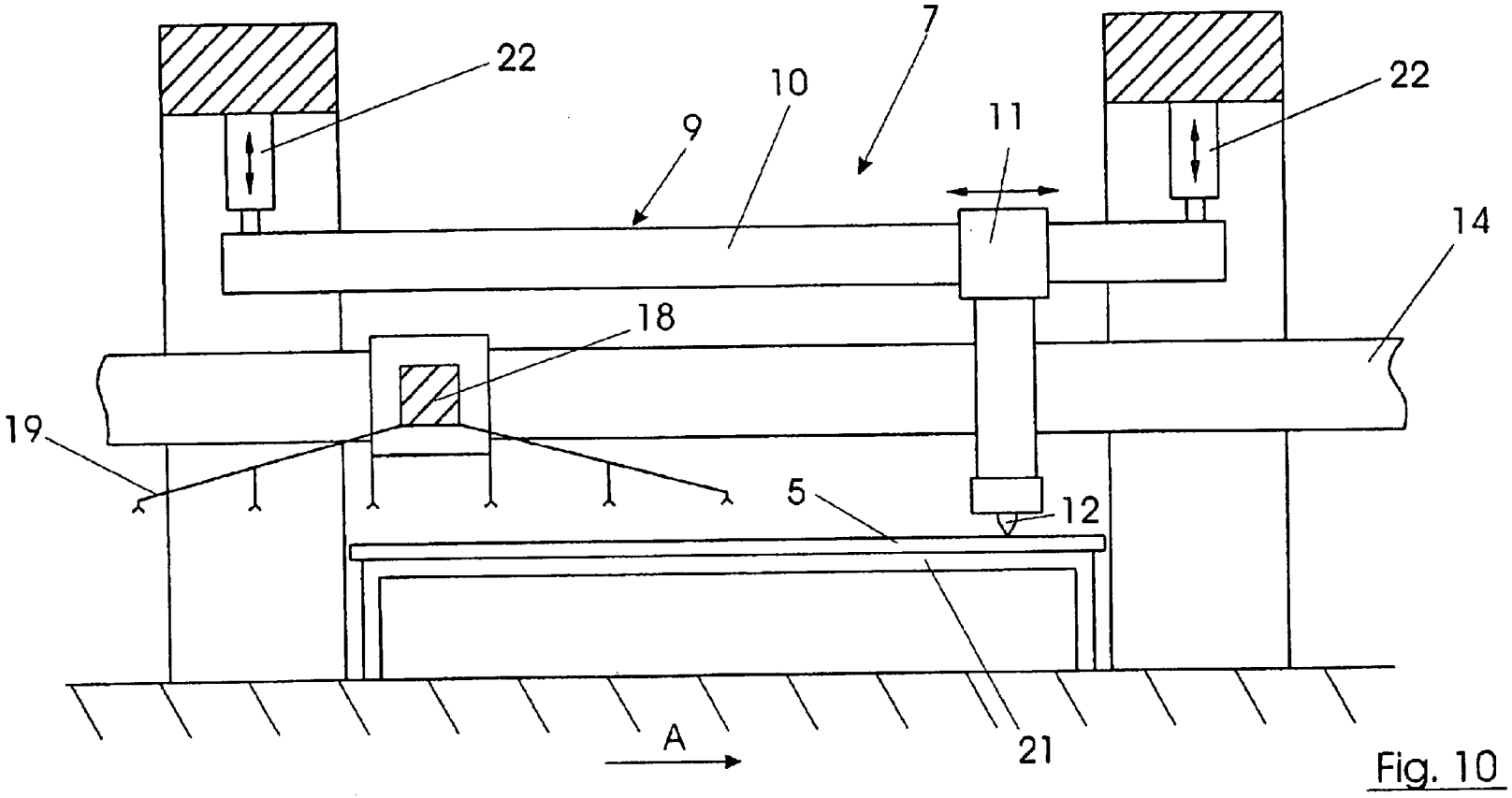
FIG. 10 is a schematic view of an alternative embodiment of the representation according to FIG. 7.
Figure 11:
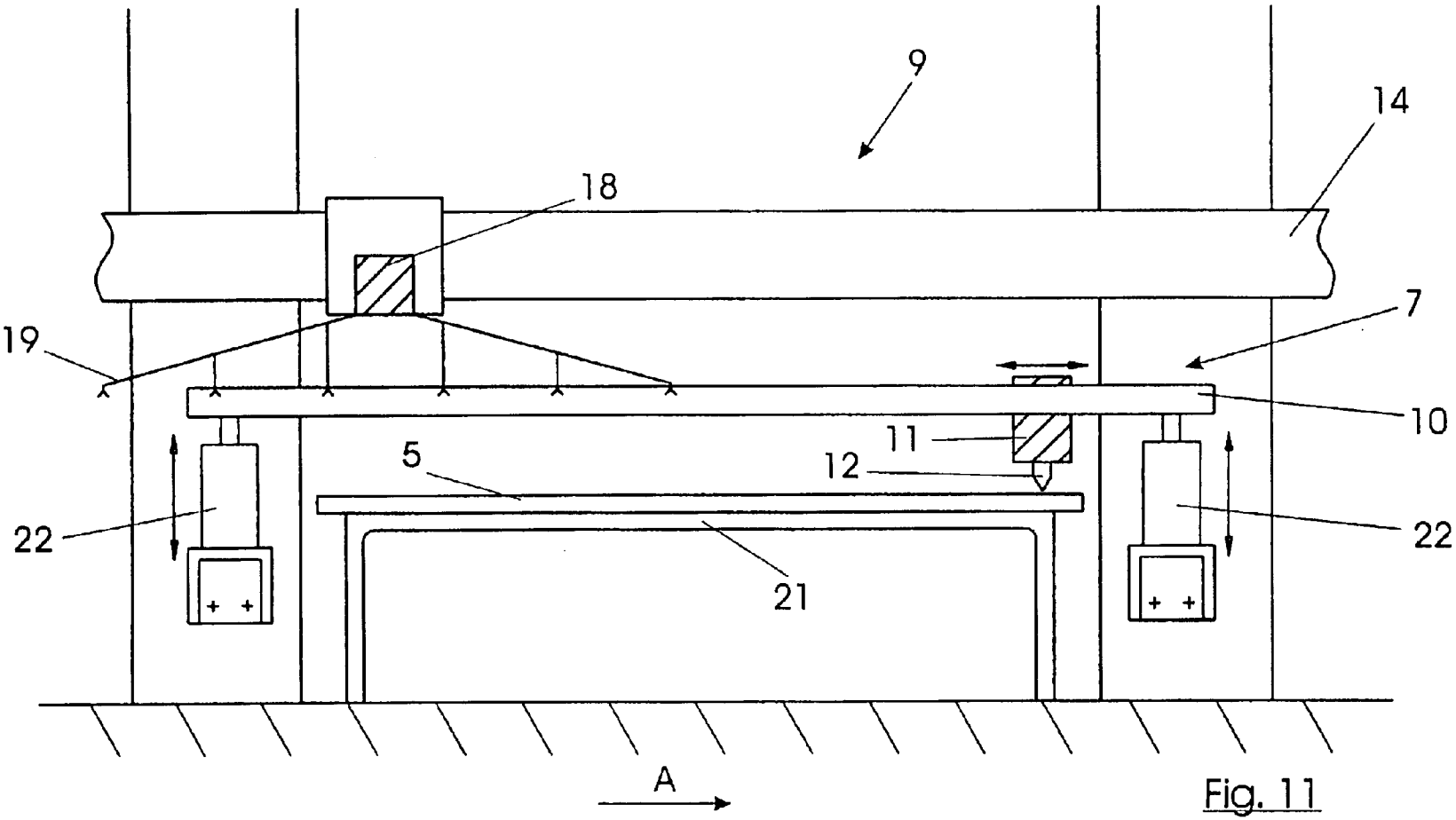
FIG. 11 is a schematic view of another alternative embodiment of the representation according to FIG. 7.

FIGS. 10 and 11 are additional lateral views of laser machining devices 7, one laser head 12 respectively being mounted on the cross table 9 which again consists of longitudinal traverses 10 and a cross traverse 11. In the embodiment according to FIG. 10, the cross table 9 is situated above the lifting beams 14 of the transport device 6 for the workpieces 5, on which the suction bridge 18 is also mounted. In contrast, according to FIG. 11, the cross table 9 for the laser heads 12 is arranged below the transport device 6 for the workpieces 5. The cross traverse 11 carrying the laser heads 12 is moved toward the front and toward the rear in the transport direction for the removal and insertion of the parts. In the embodiment according to FIG. 10, the laser head 12 can also be lifted by the stroke beams 14.

In both embodiments, the cross tables 9 are provided with stroke elements 22 which permit a three-dimensional machining by the laser heads 12. Such a three-dimensional machining of the workpieces 5 is practical if the workpieces 5 had already been machined previously in a drawing stage and therefore have a three-dimensional shape. The stroke elements 22 are applied in each case to the longitudinal traverses 10.

In both illustrated cases, it is possible to start with the machining of the workpieces 5 by the laser heads 12 already during the moving-back of the suction bridge 18. In this context, the programming of the sequences in the forming system 1 has the result that there are no collisions between parts of the transport device 6 and parts of the laser machining device 7.

In addition, the guiding element 14 of the transport device 6 can also be used for guiding the cross traverse carrying the laser heads 12. Also, the cross traverse 11 carrying the laser heads 12 can be articulated and be equipped with a telescope sleeve, in order to permit a diagonal position of the cross traverse 11 and therefore different speeds of the laser heads 12 in the transport direction. This is advantageous for achieving diagonal cuts or welds by the laser heads 12.

Figure 12:
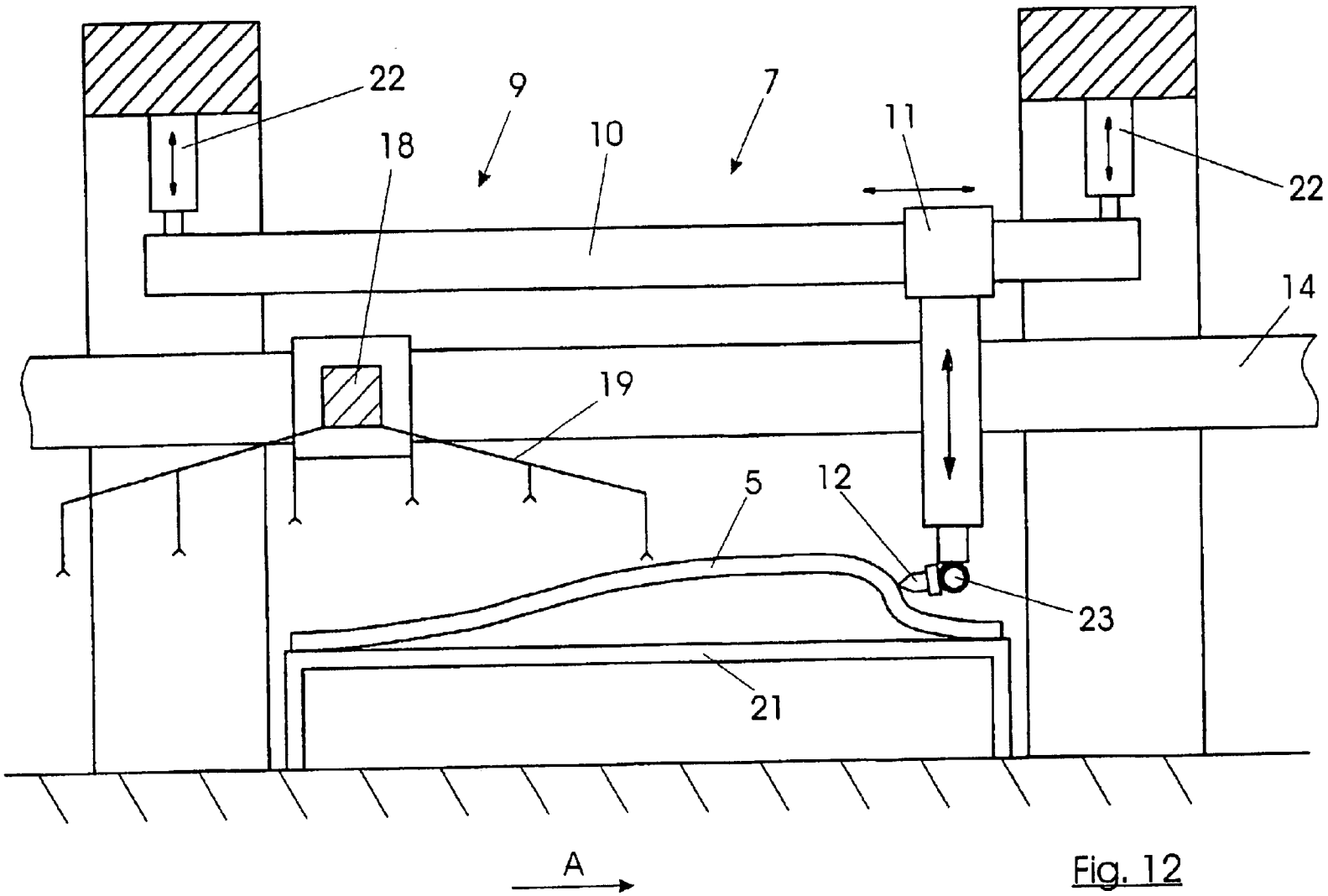
FIG. 12 is a schematic view of an alternative embodiment of the forming system for cutting non-planar blanks.

FIG. 12 illustrates an alternative embodiment of the laser machining device 7. The basic construction corresponds to that illustrated in FIG. 10. In FIG. 12, however, the machining element or the laser head 12 are mounted by way of a swivel element 23 on the manipulation device 9 consisting of the longitudinal traverse 10 and of the cross traverse 11 and can therefore be swivelled. As a result, as illustrated, complicated shapes of workpieces 5 can also be machined. By swivelling the machining elements 12, the beam emanating therefrom can always impinge vertically on the workpiece 5. The mobility of the manipulation device 9 is indicated by double-headed arrows.

Figure 13:
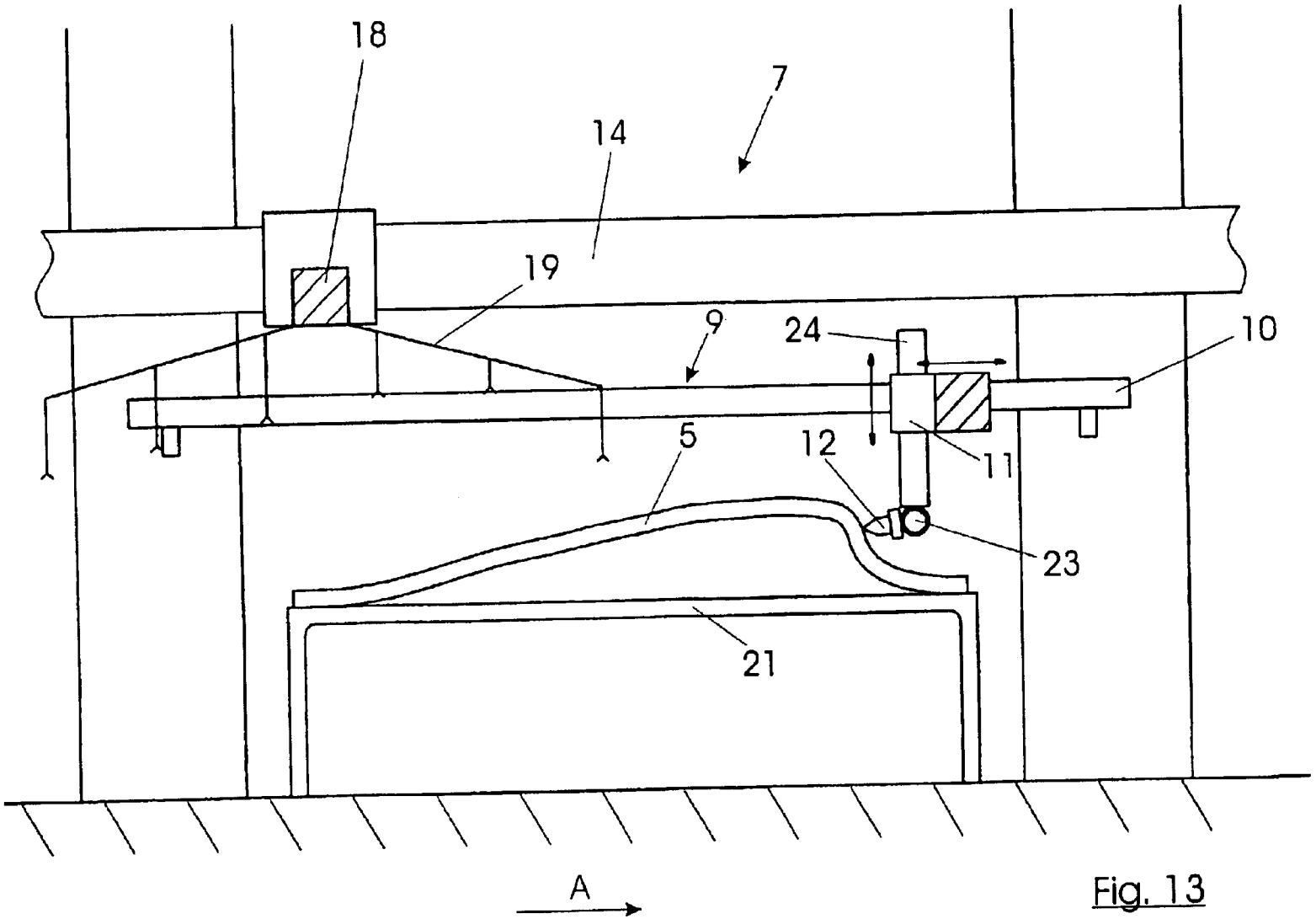
FIG. 13 is a view of another alternative embodiment of the forming system for cutting non-planar blanks.

FIG. 13 illustrates another possible laser machining device 7, in the case of which the machining element 12 is also swivellably mounted by way of the swivelling element 23 on the manipulation device 9. The stroke elements 22 are not necessary in this case because the machining element 12 is arranged on the cross traverse 11 by a vertical guiding element 24 and thus can be moved in the vertical direction toward or away from the workpiece 5.

Figures 14, 15:
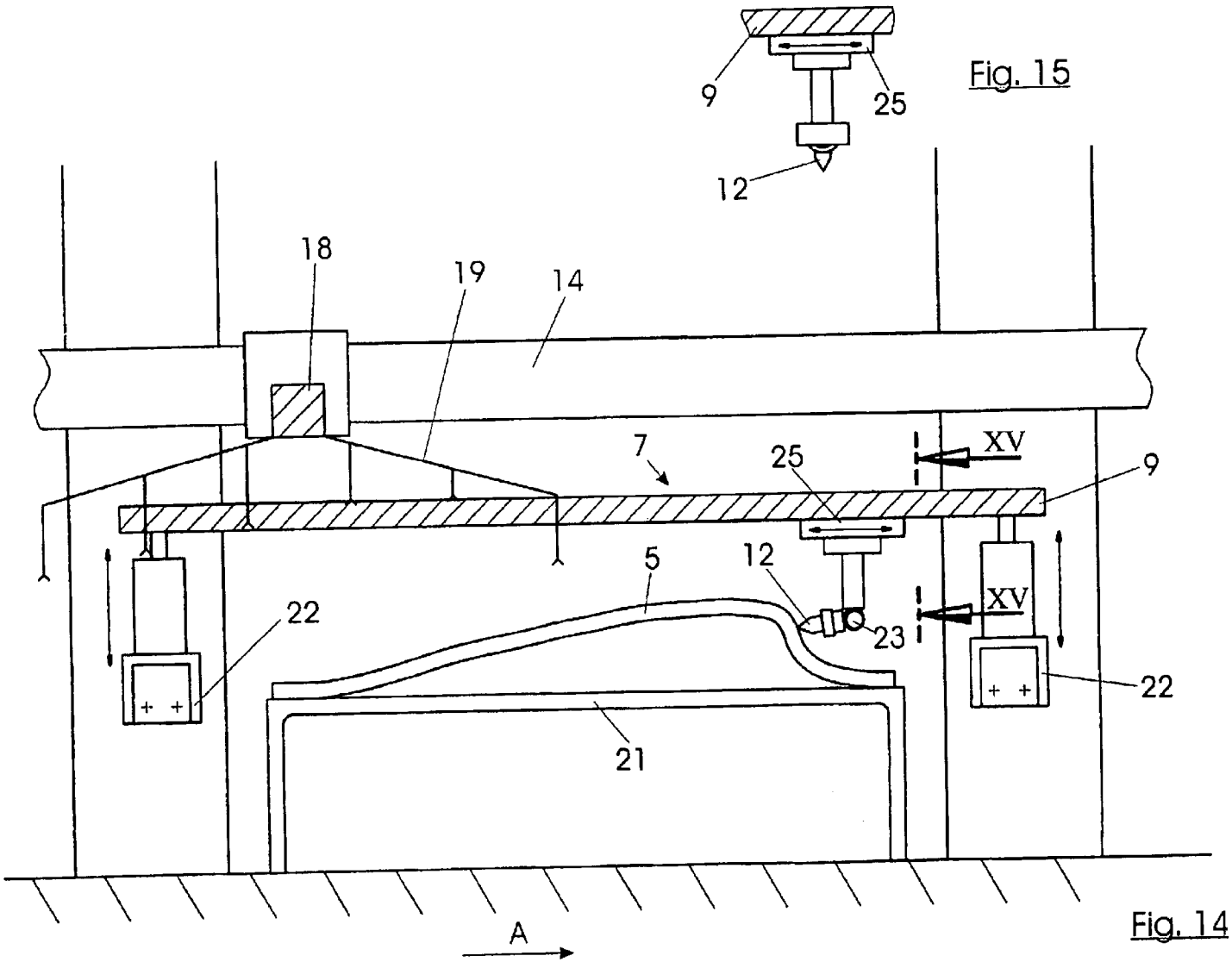
FIG. 14 is a view of another alternative embodiment of the forming system for cutting non-planar blanks.
FIG. 15 is a sectional view along line XV—XV of FIG. 14.

In the embodiment according to FIG. 14, the manipulation device 9 is a plate-shaped element on which the machining element 12 is swivellably mounted by way of a linear guide element 25. A linear guidance of this type by way of the linear guide element 25, which is also called a direct guide, permits the arranging of several machining elements 12 on the plate-shaped element 9. The linear guide elements 25 can be moved arbitrarily in a plane on the plate-shaped element 9 and thus move the machining element or the laser head 12 for the machining of the workpiece 5 over the latter. Of course, the mounting of several machining elements 12 on one and the same linear guide element 25 is also contemplated.

The plate-shaped element 9 can be adjusted in its height by way of the stroke elements 22. In this case, the linear guide elements 25 are held on the plate-shaped element 9 by magnetic force. FIG. 15 is a sectional view of the plate-shaped element 9. The machining element or the laser head 12 and the linear guide element are also visible here.

Figure 16:
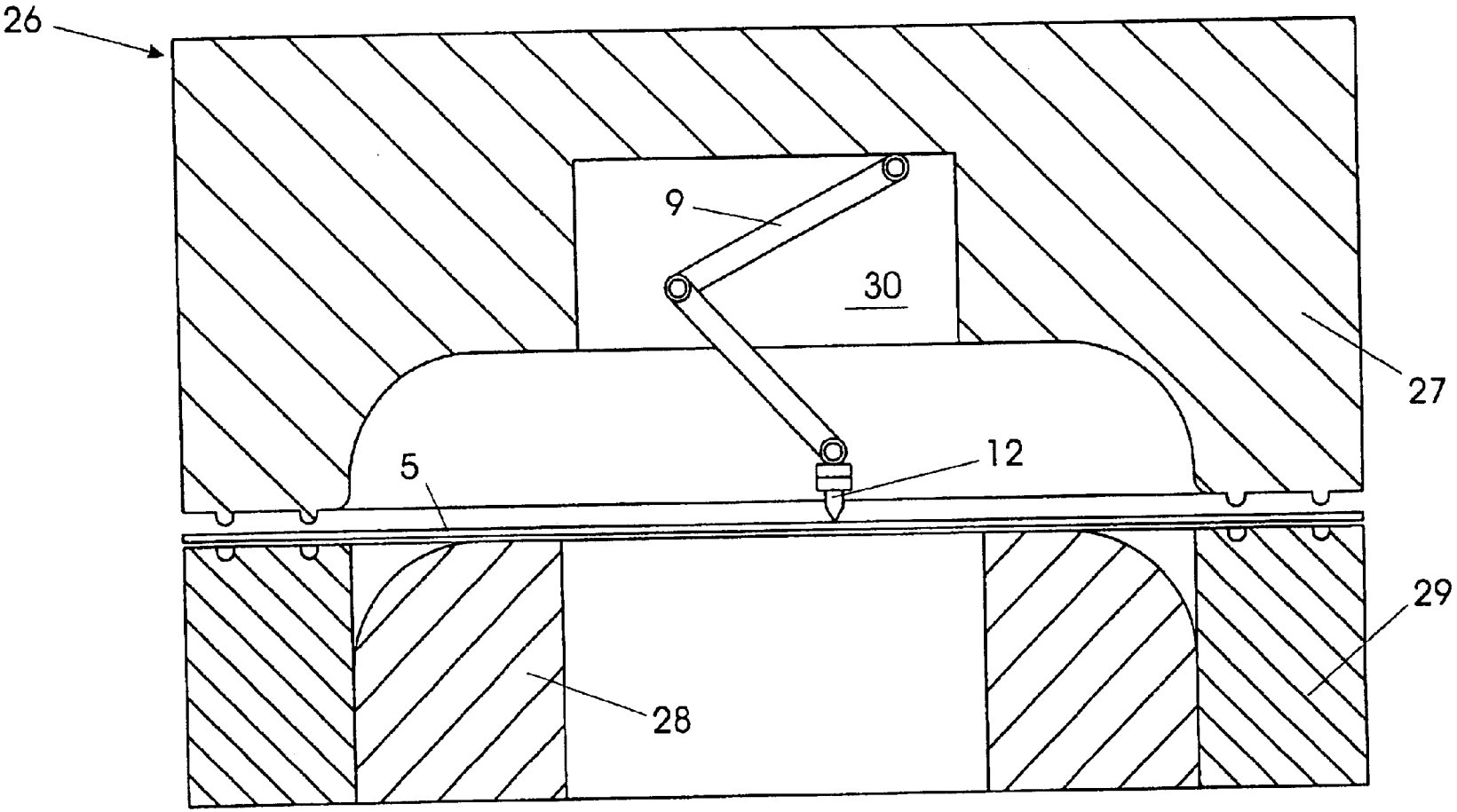
FIG. 16 is a schematic view of an arrangement of a laser machining device in a forming tool, specifically in a hollow space of a top tool.
Figure 17:
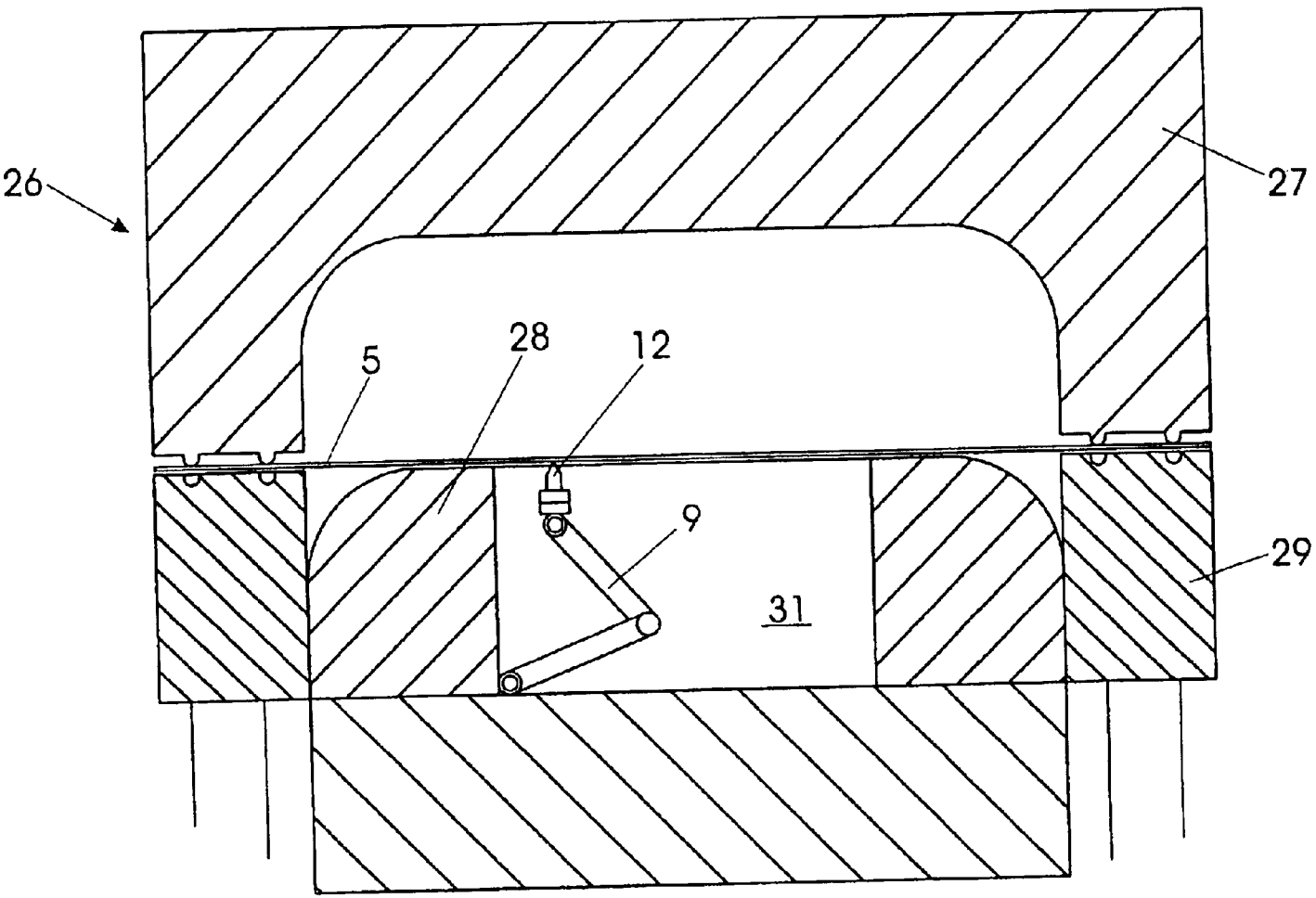
FIG. 17 is a schematic view of an arrangement of a laser machining device in a forming tool, specifically in a hollow space of a bottom tool.
Figure 18:
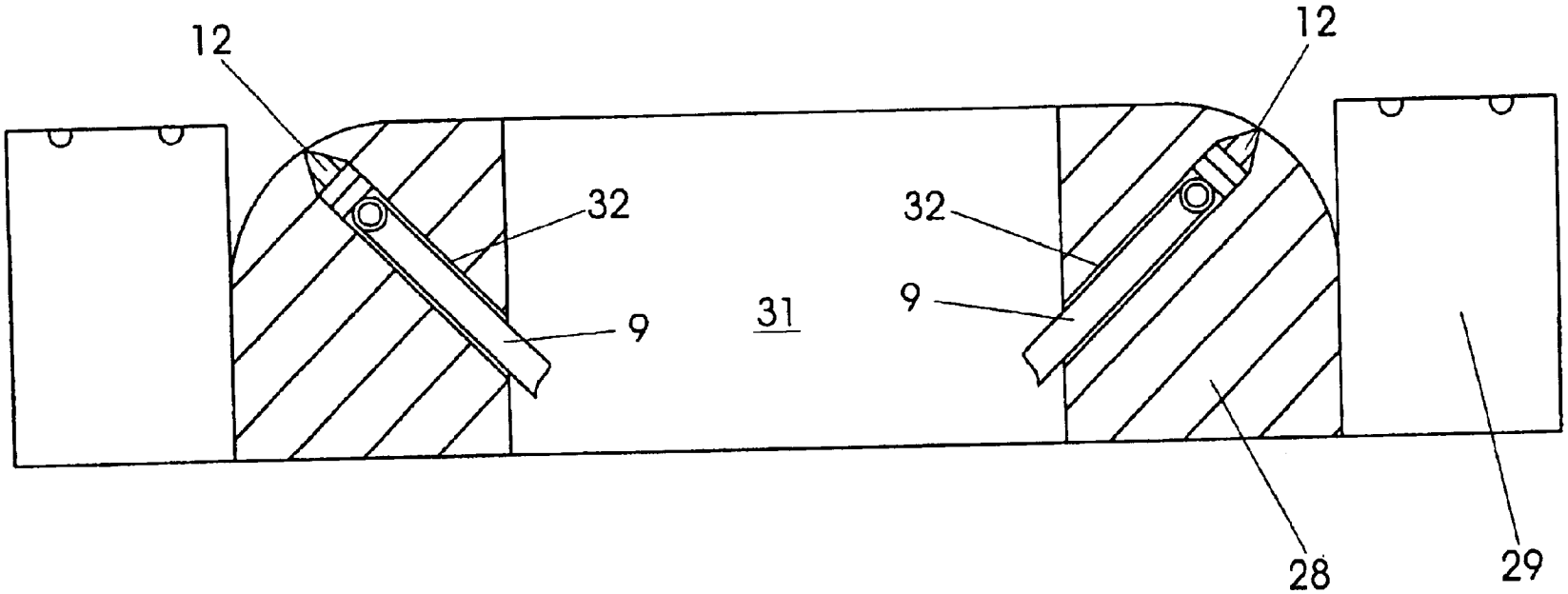
FIG. 18 is a view of an arrangement of a laser machining device in a forming tool, specifically directly in the bottom tool.

FIGS. 16, 17 and 18 show the integration of the laser machining device 7 directly in a forming tool 26 which is assigned to one of the forming stations 2. In a generally known, the forming tool 26 consists of a tool top part 27, a tool bottom part 28 and a metal sheet holder 29 which, together with the tool top part 27, holds the workpiece 5 to be formed. The metal sheet holder 29 moves downward against the spring pressure of a spring when the tool top part 27 is placed on the workpiece 5 or on the tool bottom part 28.

According to FIG. 16, a recess 30 is situated in the tool top part 27. In this recess 30, a manipulation device is arranged which is constructed as a swivel arm robot 9 and has a machining element or laser head 12. The swivel arm robot 9 is capable of moving the laser head 12 along the workpiece 5 such that this workpiece is three-dimensionally machined, for example, cut by the laser head 12 mounted thereon. This is also possible during the formation of the workpiece 5 by the forming tool 26, specifically in that damage to the forming tool 26 is excluded. In this embodiment, it is mainly advantageous that the workpiece 5 is held in the forming tool 26 for preventing an elastic relaxation. In FIG. 17, the swivel arm robot 9 is situated in a recess 31 of the tool bottom part 28 and has the same function as the swivel arm robot 9 of FIG. 16.

According to FIG. 18, bores 32 are arranged in the tool bottom part 28 starting from the recess 31, in which bores 32 one laser head 12 respectively is situated. These laser heads 12 can machine the workpiece 5 during the forming movement in the forming station 2; e.g., subject the workpiece to a thermal treatment and thus replace an otherwise required annealing treatment. As illustrated, the laser heads 12 can be housed by a swivel arm robot 9 or stationarily in the bore 32. A similar configuration of the laser heads 12 is also conceivable in the tool top part 27.

Again, it is to be understood that, also with the integration of the laser machining device 7-into the forming tool 26 illustrated in FIG. 18, care is taken that the laser beam emanating from the laser heads 12 does not damage parts of the forming tool 26.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A forming system for forming workpieces, comprising a plurality of stations, at least one forming tool, and at least one machining device with a local energy feed for machining the workpieces is configured to be movable in multiple planes and is arranged as a separate station within the forming system, wherein the at least one machining device is provided with at least one machining element for machining the workpieces and is arranged within the at least one forming tool.

2. The system according to claim 1, wherein the at least one machining device is operatively arranged in at least one of a recess of a tool top part and a tool bottom part of the at least one forming tool.

3. The system according to claim 2, wherein the at least one machining device is arranged by way of a manipulation device in or on one of the tool top part and the tool bottom part.

4. The system according to claim 2, wherein the at least one machining device is stationarily arranged in one of the tool top part and the tool bottom part.

5. A forming system for forming workpieces, comprising a plurality of stations, at least one forming tool, and at least one machining device with a local energy feed for machining the workpieces is arranged as a separate station within the forming system wherein the forming system comprises a multi-station forming system with plural forming stations, and the at least one machining device is arranged between two of the plural forming stations.

6. A forming system for forming workpieces, comprising a plurality of stations, at least one forming tool, and at least one machining device with a local energy feed for machining the workpieces is arranges as a separate station within the forming system wherein two or more machining stations are arranged parallel to one another and are operatively connected behind or in front of a common forming station.

* * * * *